United States Patent [19]

Edgerton

[11] Patent Number: 4,665,633

[45] Date of Patent: May 19, 1987

[54] SHOE TOP COVER

[76] Inventor: Preston Edgerton, 810 North Ave., Newport News, Va. 23605

[21] Appl. No.: 911,744

[22] Filed: Sep. 26, 1986

[51] Int. Cl.[4] ..... A41D 17/00

[52] U.S. Cl. ..... 36/2 R; 36/72 R; 36/7.1 R

[58] Field of Search ..... 36/1.5, 2 R, 2 A, 2 B, 36/9 R, 7.1 R, 7.2, 72 R, 73; 2/242, 269

[56] References Cited

U.S. PATENT DOCUMENTS

| | | | |
|---|---|---|---|
| 1,097,354 | 5/1914 | Outerbridge, Jr. | 36/2 B |
| 2,009,476 | 11/1937 | Glowka | 36/2 R |
| 2,053,813 | 9/1936 | Brennan | 36/1.5 |
| 2,145,061 | 1/1939 | Stuart | 36/2 R |
| 2,229,563 | 1/1941 | Greenstein | 36/2 R |
| 2,392,867 | 1/1946 | Stoner et al. | 36/72 R |
| 2,420,618 | 5/1947 | Rabinovitz | 36/2 R |
| 2,422,669 | 6/1947 | Gygi | 36/2 R |
| 2,625,752 | 1/1953 | Kemp | 36/72 R |
| 4,461,098 | 7/1984 | Diegelman | 36/2 R |

FOREIGN PATENT DOCUMENTS

| | | | |
|---|---|---|---|
| 59440 | 12/1912 | Austria | 36/2 R |
| 1126925 | 12/1956 | France | 36/2 R |

*Primary Examiner*—Werner H. Schroeder
*Assistant Examiner*—Steven N. Meyers
*Attorney, Agent, or Firm*—Nies, Webner, Kurz & Bergert

[57] ABSTRACT

A sole-less shoe top cover is formed of a single thickness of flexible fabric for protecting a shoe upper from paint or plaster drippings. Three vertically spaced lines of stitched elastic cords are stitched in-and-out around the lower portion of the cover.

2 Claims, 4 Drawing Figures

SHOE TOP COVER

FIELD OF INVENTION

Class 36, subclass 72.

OBJECTS

The primary object of this invention is to provide a sole-less shoe top cover for protecting the shoes of plasterers, painters and other workmen whose shoe tops are subjected to ruination by drippings and spatterings of material. Shoe top covers, broadly speaking, are well known but insofar as is known, they have one problem not heretofore solved, resulting from wear of their exposed lower edges. If the lower sides of the shoe uppers and the side edges of the shoe soles are to be protected, this means that the lower edge portions of the protector must extend downwardly far enough so that their edges are subjected to wear by being walked on, and they become frayed and ragged.

The object of this invention is to provide a means whereby the frayed or ragged edges can be easily removed.

The foregoing problem is solved by this invention is to provide parallel lines of elastic cords which are stitched in and out around the lower portions of a fabric shoe top protector which gather the fabric between the in-end-out excursions of the cord so as to provide great stretchability of the lower portion of the protector with a dual function of providing elasticity of the cover and a cutting line whereby, when the lower side edges of the cover become ragged or frayed they may be cut off immediately below one of the cords, leaving a straight edge to finished appearance.

Yet another object is to provide a shoe top cover formed by a single ply of fabric whose lower portion is made stretchable by elastic cords which are stitched in and out to form gathers which extend generally vertically, and which cover is held onto the wearer's shoes by the elastic strap beneath the shoe instep so that the frontal portion of the cover may be peeled back to expose the frontal portion of the wearer's shoe upper when it is desired not to use the cover. Such instances occur, for example, when the user desires to walk around without having the lower edges of the cover drag on the floor.

These and other objects will be apparent from the following specifications and drawings in which.

Figure 1:
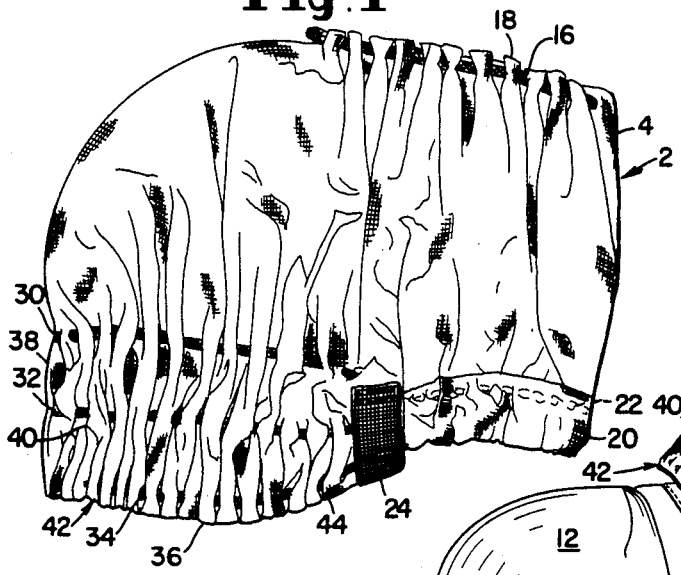
FIG. 1 is a side elevation of the shoe top cover unstretched and removed from a shoe.
Figure 2:
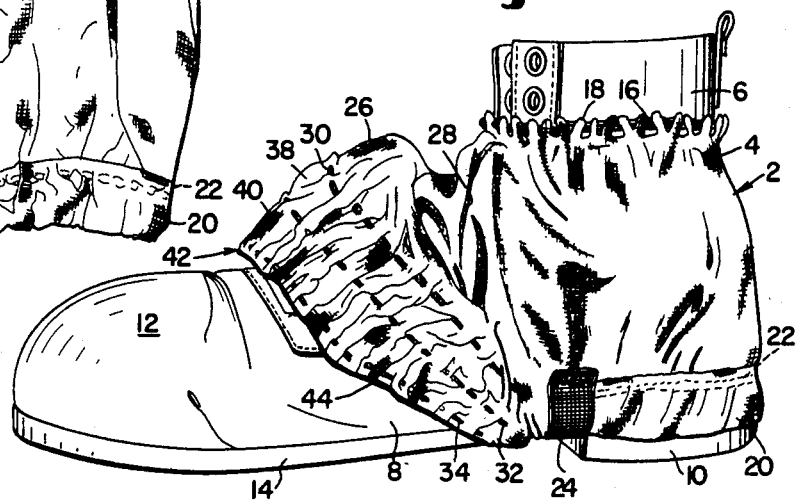
FIG. 2 is a perspective view of the shoe top cover on a shoe, with the forward portion of the cover peeled back to expose the shoe upper.
Figure 3:
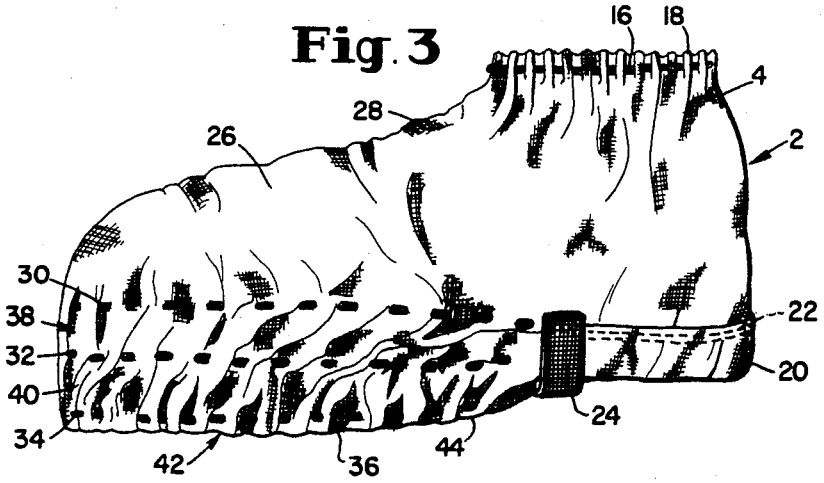
FIG. 3 is a side elevation of the shoe top cover removed from a shoe but in stretched condition as would appear if mounted on a shoe; and, FIG. 4 is a side elevation of the shoe top cover mounted on a shoe, and with the lower portion cut off immediately below a line of elastic cord stitching.
Figure 4:
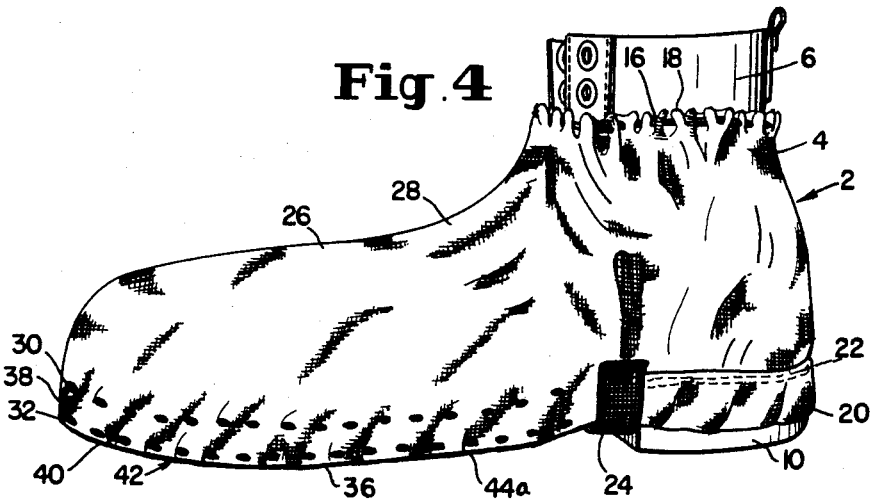

Referring now to the drawings, in which like reference numerals denote similar elements, the shoe top cover 2 is formed of a flexible fabric, such as canvas. The cover has an ankle portion 4 which engages around the ankle portion 6 of a conventional shoe. The shoe has a heel 10, toe 12, and sole 14. The ankle portion of the cover is made stretchable by an elastic cord 16 stitched in and out to provide gathers 18. The heel covering portion 20 is held in place by an elastic cord 22 which runs in a tube (not shown) around the top of the heel portion, which cord is secured at its ends to an elastic instep strap 24. The portion of the cover thus far described is not greatly different from the known prior art. The invention is as follows:

Around the lower portion of the front of the heel cover are three lines of stitching formed by elastic cords 30, 32, and 34 which are stitched in and out to form gathers 36. The cords thus form three vertically spaced lines of stitching 38, 40, and 42. When the lower edge 44 of the forward portion of the cover become worn or frayed, the frayed lower portion may be cut away by cutting the fabric immediately below the line of stitching 40, thus leaving a new and clean-cut bottom edge 44*a* so that the cover maintains a neat appearance as shown in FIG. 4.

I claim:

1. A sole-less shoe top cover comprising a single ply of flexible fabric having a rear portion adapted to fit over the ankle and heel portions of a shoe and a forward portion adapted to fit over the instep and toe portions of a shoe, said forward portion having a depending band extending downwardly from the toe and instep covering portions, and three vertically spaced elastic cords defining three vertically spaced lines of stitching and gatherings of the material of the depending band, thereby providing stretchable elasticity of the fabric of the depending band and whereby the forward portion of the cover may be peeled back from over the toe portion of the shoe, one or more of the lines of stitching providing a guide line for cutting off a portion of the band when the band becomes worn or frayed.

2. A sole-less shoe cover as claimed in claim 1 and a flexible elastic band having opposite ends connected to the cover and running beneath the instep of the shoe for holding the cover onto the shoe when the forward portion of the cover is peeled back from over the shoe toe portion.

* * * * *